US009820619B2

(12) United States Patent
Cohen et al.

(10) Patent No.: US 9,820,619 B2
(45) Date of Patent: Nov. 21, 2017

(54) BATHTUB SUPPORT MEMBER

(71) Applicant: Kohler Co., Kohler, WI (US)

(72) Inventors: Benjamin S. Cohen, Sheboygan, WI (US); Jeffrey F. Tempas, Oostburg, WI (US); James N. Jaeckels, Sheboygan Falls, WI (US); Darren R. Wojahn, Grafton, WI (US); Santosh R. Narasimhan, Port Washington, WI (US); Adam W. Dwyer, Plymouth, WI (US); Logan M. Tatem, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 60 days.

(21) Appl. No.: 14/966,773

(22) Filed: Dec. 11, 2015

(65) Prior Publication Data

US 2017/0164788 A1 Jun. 15, 2017

(51) Int. Cl.

| | |
|---|---|
| ***A47K 3/02*** | (2006.01) |
| ***A47K 3/16*** | (2006.01) |
| ***E03C 1/22*** | (2006.01) |

(52) U.S. Cl.

CPC ..... *A47K 3/02* (2013.01); *A47K 3/16* (2013.01); *E03C 1/22* (2013.01); *A47K 3/1605* (2013.01)

(58) Field of Classification Search

CPC ..... A47K 3/02; A47K 3/16
USPC ..... 4/538, 592, 593
See application file for complete search history.

(56) References Cited

U.S. PATENT DOCUMENTS

| | | | | | |
|---|---|---|---|---|---|
| 790,229 | A | * | 5/1905 | Sloman | A47K 3/16 4/593 |
| 3,046,568 | A | | 7/1962 | Holberson | |
| 3,561,019 | A | | 2/1971 | Roland | |
| 4,551,869 | A | * | 11/1985 | Whitney | A47K 3/17 4/589 |
| 5,459,888 | A | * | 10/1995 | Chen | A47K 3/16 4/593 |
| 5,494,718 | A | | 2/1996 | Adams et al. | |
| 2010/0175761 | A1 | | 7/2010 | Schlueter | |

FOREIGN PATENT DOCUMENTS

| | | |
|---|---|---|
| DE | 9410545 U1 | 12/1995 |
| DE | 29613216 U1 | 1/1998 |
| DE | 202006008346 | 1/2011 |
| EP | 0864286 B1 | 9/1998 |
| FR | 2387014 | 11/1978 |
| GB | 591294 | 8/1947 |
| GB | 2261165 | 5/1993 |
| GB | 2278541 | 7/1994 |
| WO | WO 02/19884 A1 | 3/2002 |

* cited by examiner

*Primary Examiner* — Huyen Le
(74) *Attorney, Agent, or Firm* — Foley & Lardner LLP

(57) ABSTRACT

A support member for a bathtub comprises a base and a plurality of flexible elements. The base includes an upper surface configured to be coupled to a bathtub. The plurality of flexible elements extend laterally outward from a side of the base and are configured to engage a lower portion of the bathtub.

18 Claims, 4 Drawing Sheets

BATHTUB SUPPORT MEMBER

BACKGROUND

The present application relates generally to the field of bathtubs, and in particular, to support members for polymeric bathtubs.

Generally speaking, traditional polymeric bathtubs, such as thermoformed bathtubs, can include a support member coupled to or integrally formed with the tub. The support member can, advantageously, provide additional structural strength and rigidity to the tub structure. Many traditional support members for polymeric bathtubs include, for example, a coat of fiberglass resin or cast resin applied to a bottom portion of the tub. The fiberglass resin or cast resin can provide additional stiffness and strength to the bathtub structure.

The fiberglass or cast resin can, however, add significant weight to the bathtub. Furthermore, the fiberglass or cast resin can be unsightly, because it can create additional seams or surface textures on the bathtub surface. In addition, the fiberglass or cast resin can result in injuries or discomfort to a person handling the bathtub, because the fibers or resin can cause irritation and/or can embed in a person's hands.

Moreover, a problem can arise with polymeric bathtubs, because there can be variation in the overall size or dimensions of the tub resulting from, for example, a thermoforming process. Conventional bathtub support members are not configured or designed to address this particular problem associated with thermoformed tubs. That is to say, conventional support members have fixed dimensions, and are not capable of adapting to bathtubs having variations in size. Thus, a conventional support member may not be able to fit or be used across polymeric bathtubs having size variations.

Thus, there is a need for a support member for a polymeric bathtub that addresses one or more of the above noted limitations associated with traditional bathtub supports. These and other advantageous features will become apparent to those reviewing the present disclosure.

SUMMARY

One embodiment relates to a support member for a bathtub. The support member comprises a base and a plurality of flexible elements. The base includes an upper surface configured to be coupled to a bathtub. The plurality of flexible elements extend laterally outward from a side of the base and are configured to engage a lower portion of the bathtub.

Another embodiment relates to a bathtub assembly. The bathtub assembly comprises a bathtub and a support member. The support member is coupled to a lower portion of the bathtub. The support member comprises a plurality of flexible elements configured to engage the lower portion of the bathtub.

DETAILED DESCRIPTION

Referring generally to the FIGURES, disclosed herein is a support member for a bathtub or other similar type of vessel, that includes flexible elements to account for variations in the size of the bathtub resulting from, for example, a thermoforming process. In this manner, the support member can be used on bathtubs having variations in size without the need to modify the tub structure or the support member itself. This can help to improve assembly operations at the manufacturing level, can minimize or eliminate costly material scrap, and can permit greater dimensional tolerances for forming/molding operations for the bathtub.

Figure 1:
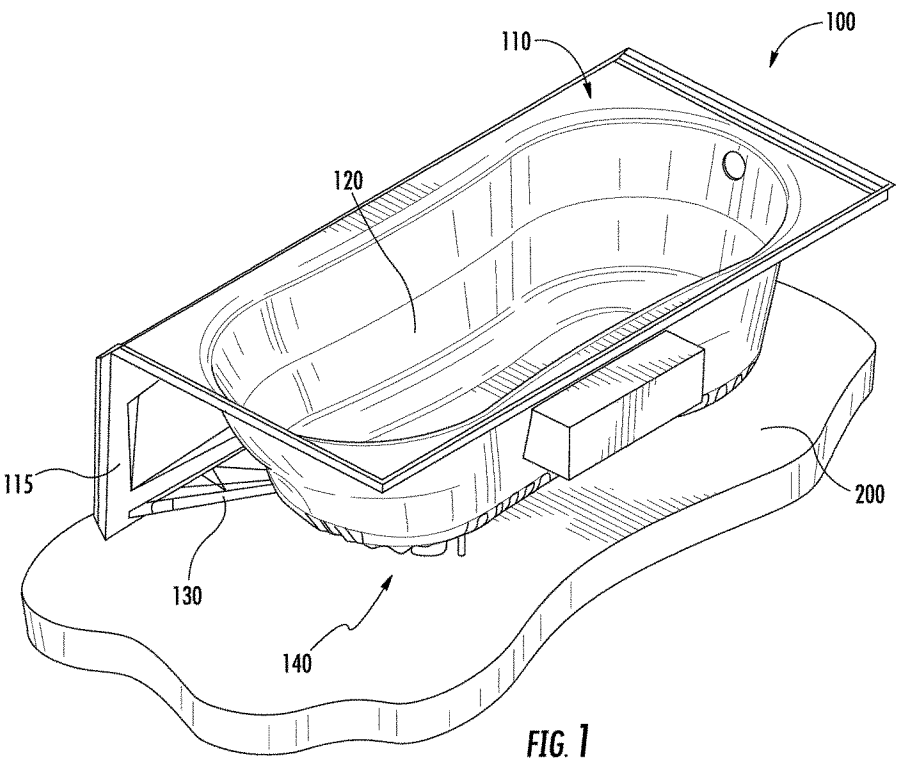
FIG. 1 is a perspective view of a bathtub assembly according to an exemplary embodiment.

Referring to FIG. 1, a bathtub assembly 100 is shown according to an exemplary embodiment. As shown in FIG. 1, the bathtub assembly 100 includes a bathtub 110 and a support member 140. The support member 140 is coupled (e.g., adhered, bonded, etc.) to a lower portion of the bathtub 110. The support member 140 can, advantageously, provide structural rigidity and support to the bathtub 110. Furthermore, the support member 140 can act as a base or support for the bathtub 110 when the bathtub assembly 100 is mounted or installed in a bathing environment, such as on a floor 200 shown in FIG. 1 (e.g., a bathroom floor, etc.). Although the support member 140 is shown coupled to a bathtub in the embodiment of FIG. 1, it is appreciated that the support member 140 may be used in conjunction with other types of vessels or tubs to provide additional structural strength and rigidity, such as, for example, Jacuzzi tubs, sinks, utility sinks, pools, or other similar types of vessels.

According to the exemplary embodiment of FIG. 1, the bathtub 110 includes a tub portion 120 (e.g., a vessel, etc.) and a wall portion 115. The wall portion 115 extends along an upper section of the tub portion 120, and downward in front of the tub portion 120 to define a front apron of the bathtub 110. The wall portion 115 includes a peripheral edge that can mate or engage with a fixed structure, such as a portion of a building or the like (e.g., a wall of a bathroom, a floor of a bathroom, etc.). The wall portion 115 can, advantageously, conceal an outer surface of the tub portion 120 from a user's view when the bathtub 110 is mounted adjacent a fixed structure of a building. According to an exemplary embodiment, the wall portion 115 is formed integrally with the tub portion 120. According to other exemplary embodiments, the wall portion 115 is coupled to the tub portion 120 (e.g., bonded, adhered, bolted, etc.). According to an exemplary embodiment, the bathtub 110 is formed by a thermoforming process using a polymeric material, such as, for example, Acrylic, co-extruded or co-laminated ABS, backed Acrylic, or High Impact Polystyrene. According to other exemplary embodiments, the bathtub 110 is made (e.g., injection molded, formed, etc.) using other rigid or semi-rigid materials or combinations of materials suitable for use in a bathing environment, such as a composite material or the like.

Figure 2:
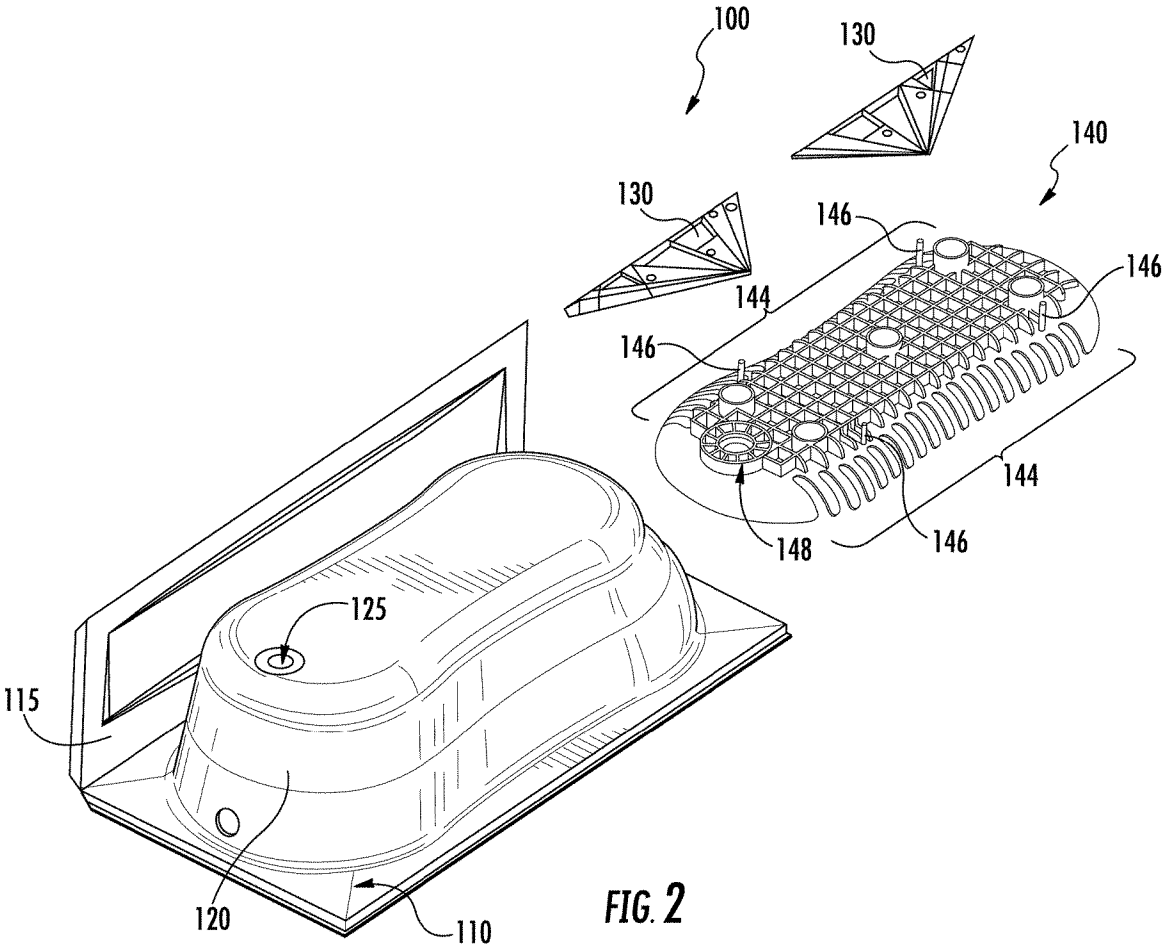
FIG. 2 is an inverted exploded view of the bathtub assembly of FIG. 1.

FIG. 2 illustrates an inverted exploded view of the bathtub assembly 100 of FIG. 1. As shown in FIGS. 1 and 2, a pair of flanges 130 (e.g., gussets, triangular members, etc.) are coupled between the support member 140 and the wall portion 115 of the bathtub 110. The flanges 130 can provide structural rigidity to the front apron of the wall portion 115, which extends downward from the upper section of the tub portion 120. In the exemplary embodiment of FIGS. 1 and 2, the flanges 130 have a triangular shape, although the flanges 130 may have other shapes, such as rectangular, cylindrical, or the like, according to other exemplary embodiments. The flanges 130 may be coupled to the wall portion 115 and to the support member 140 via one or more fasteners (e.g., bolts, screws, etc.) and/or by adhesive bonding. The flanges 130 include an opening for receiving at least a portion of a dowel 146 (e.g., a pin, a locating member, etc.) extending from the base of the support member 140 toward the ground. The dowel 146 can, advantageously, locate the flange 130 relative to the wall portion 115, and can help to couple the flange 130 thereto. According to the exemplary embodiment of FIGS. 1 and 2, the bathtub assembly 100 includes two flanges 130. However, it is appreciated that more or fewer than two flanges 130 may be used to provide sufficient structural rigidity to the front apron of the bathtub 110, according to other exemplary embodiments.

Figure 3:
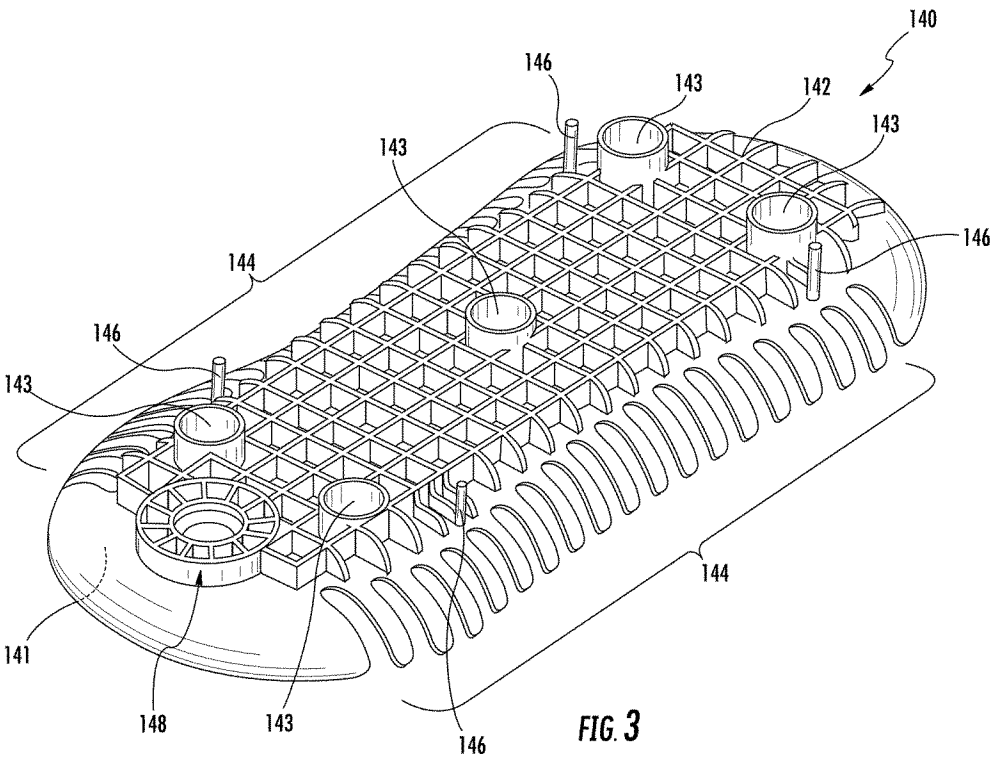
FIG. 3 is a bottom perspective view of a bathtub support member according to an exemplary embodiment.

Referring to FIGS. 2 and 3, the support member 140 can be coupled to a lower surface or portion of the tub portion 120. According to an exemplary embodiment, the support member 140 may be fixedly coupled to a lower surface of the tub portion 120 using an adhesive or other bonding agent suitable for use in a bathing environment. As shown in FIG. 2, the tub portion 120 includes a drain opening 125 for transferring fluid from within the tub portion 120 to, for example, a drain pipe (not shown). The support member 140 includes a drain aperture 148 for communicating with the drain opening 125 when the support member 140 is coupled to the tub portion 120. According to the exemplary embodiment of FIGS. 2 and 3, the support member 140 includes a plurality of flexible elements 144 (e.g., flexible fingers, flexible features, etc.) extending laterally outward at opposite sides of the support member 140. The flexible elements 144 can flex (e.g., deflect, elastically deform, move, etc.) and adapt to the size/shape of the bottom surface of the tub portion 120 when the support member 140 is coupled to the bathtub 110. In this manner, the flexible elements 144 can, advantageously, account for variations in the size of the tub portion 120, to allow for coupling of the support member 140 to the bathtub 110.

Figure 4:
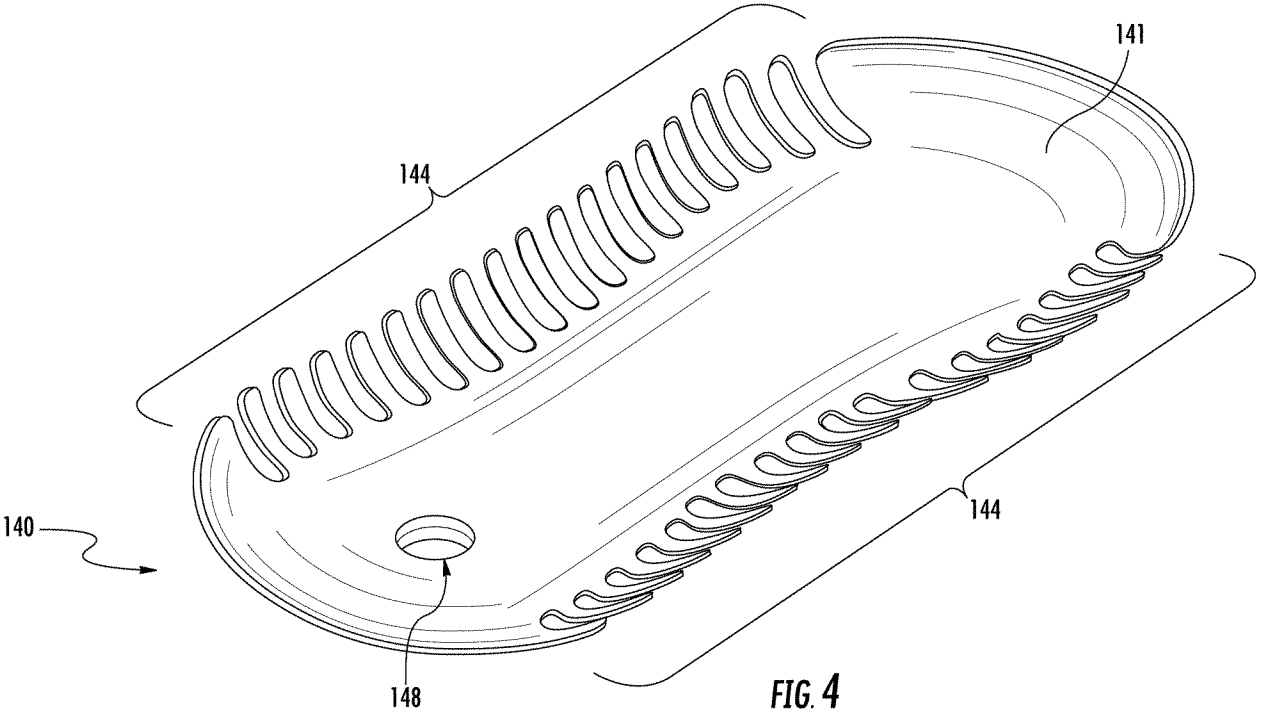
FIG. 4 is a top perspective view of the bathtub support member of FIG. 3.

Referring to FIGS. 3-4, the support member 140 includes a base 142 having a grid-like structure. The grid-like structure of the base 142 is defined by a plurality of intersecting vertical walls that are oriented perpendicular to each other, and which collectively define a plurality of pockets or openings therebetween. In this way, the support member 140 has sufficient structural rigidity and strength to support the bathtub 110, but is also lightweight, which is due, in part, to the grid-like structure of the base 142. As shown in FIGS. 3-4, the base 142 extends along a substantially horizontal plane. The support member 140 includes an upper surface 141 located opposite the base 142. The upper surface 141 has a shape that is complementary to the shape of the bottom surface of the bathtub 110, such that the upper surface 141 can mate with the bottom surface of the bathtub 110 when the support member 140 is coupled to the bathtub 110.

According to the exemplary embodiment of FIG. 4, the upper surface 141 has a contoured perimeter that extends partially upward to mimic the contoured shape of the bottom surface of the bathtub 110. As explained above, the support member 140 includes a plurality of flexible elements 144 extending laterally outward at opposed sides of the support member 140. The flexible elements 144 each extend laterally outward away from the base 142, and terminate at an outer side periphery of the support member 140. According to an exemplary embodiment, the flexible elements 144 are laterally spaced apart equidistant from each other. The flexible elements 144 may have a shape that is complementary to the bottom surface of the tub portion 120 of the bathtub 110, such as an arcuate shape (e.g., curved, etc.). In this manner, the flexible elements 144 can mate or engage with the lower portion of the tub portion 120.

According to an exemplary embodiment, the flexible elements 144 can flex or deflect when the support member 140 is coupled to the tub portion 120, so as to, for example, account for variations in the size of the tub portion 120 resulting from a thermoforming process. For example, when the support member 144 is being coupled to a lower portion of the bathtub 110, each of the flexible elements 144 can flex in either a generally downward or a generally upward direction, such that the flexible elements 144 cooperatively define an adaptable, form-fitting support surface for the bathtub 110. Each of the flexible elements 144 can move or flex in either direction to adapt to a shape of the lower portion of the bathtub 110 during, for example, the assembly process (e.g., at a factory, at an installation site, etc.).

According to an exemplary embodiment, each of the flexible elements 144 has a length in the range of about 3.0 inches to about 5.5 inches, and can flex or deflect a distance in the range of up to about 3.0 inches from a static position. Each of the flexible elements 144 can have a thickness in the range of about 0.080 inches to about 0.10 inches. The flexible elements 144 may be laterally spaced apart from each other by a distance in the range of about 0.125 inches to about 2.0 inches. However, it is appreciated that the flexible elements 144 may have different thicknesses or spacing, according to other exemplary embodiments. According to various exemplary embodiments, the flexible elements 144 can be located along a front portion, a rear portion, or along the entire perimeter of the support member 140. As shown in FIGS. 3-4, each of the flexible elements 144 has an arcuate shape that mimics the shape of a lower portion of the bathtub 110. The flexible elements 144 each include a rounded, outer peripheral edge, so as to eliminate sharp corners that may cause injury to a person handling the support member 140.

Still referring to FIG. 3, a plurality of feet 143 (e.g., mounting features, supports, etc.) are located at various positions along the base 142. The plurality of feet 143 each extend downward past the base 142 toward the ground to cooperatively define an outermost surface of the support member 140. According to the exemplary embodiment of FIG. 3, the feet 143 have a substantially hollow, cylindrical shape, although the feet 143 may have other shapes, according to other exemplary embodiments (e.g., rectangular, pentagonal, octagonal, etc.). The feet 143 can mate or engage with, for example, a floor (e.g., floor 200 of FIG. 1) or other fixed structure when the support member 140 and the bathtub 110 are mounted or installed thereto. The support member 140 further includes a plurality of dowels 146 extending from the base 142. As previously explained, the dowels 146 can couple the flange 130 to the bathtub 110 (see, for example, FIGS. 1 and 2).

According to an exemplary embodiment, the support member 140 is made (e.g., molded, formed, etc.) from a polymeric material, such as polypropylene or other similar polymeric material. According to various exemplary embodiments, the polymeric material may include fillers, such as glass fillers, fiber fillers, or the like. According to other exemplary embodiments, the support member 140 is made from another rigid or semi-rigid material or combinations of materials suitable for the particular application of the support member 140 in the bathtub assembly 100 (e.g., composite materials, rubber, etc.).

In the manner described above, the support member 140 can, advantageously, account for variations in the size of a thermoformed bathtub or other similar type of vessel, to allow for coupling of the support member to the bathtub without having to modify the tub structure or the support member itself. This can help to improve assembly operations at the manufacturing level, can minimize or eliminate costly material scrap, and can permit greater dimensional tolerances for forming/molding operations for the bathtub.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A support member for a bathtub, comprising:

a base including an upper surface configured to be coupled to a bathtub; and a plurality of flexible elements extending laterally outward from a side of the base a first distance and configured to engage a lower portion of the bathtub;

wherein the plurality of flexible elements are spaced apart from each other a second distance that is less than the first distance; and wherein the plurality of flexible elements are each configured to flex in response to the support member being coupled to the bathtub so as to adapt to a shape of the lower portion of the bathtub.

2. The support member of claim 1, wherein the base includes a grid-like structure located opposite the upper surface.

3. The support member of claim 1, further comprising a plurality of feet extending from the base and configured to engage a fixed structure for mounting the bathtub.

4. The support member of claim 1, wherein the upper surface of the base is complementary to a lower surface of the bathtub.

5. The support member of claim 1, wherein the plurality of flexible elements are each spaced laterally apart from each another.

6. The support member of claim 1, wherein the plurality of flexible elements extend laterally outward from opposite sides of the support member.

7. The support member of claim 1, wherein the plurality of flexible elements have a shape that is complementary to a shape of the lower portion of the bathtub.

8. The support member of claim 1, wherein the support member is configured to be adhesively bonded to the lower portion of the bathtub at the upper surface of the base.

9. The support member of claim 1, further comprising a drain aperture disposed in the base and configured to communicate with a drain opening of the bathtub.

10. A bathtub assembly, comprising:

a bathtub; and a support member coupled to a lower portion of the bathtub;

wherein the support member comprises a plurality of flexible elements extending laterally outward a first distance and are spaced apart from each other a second distance that is less than the first distance, wherein the plurality of flexible elements are configured to engage the lower portion of the bathtub; and wherein the plurality of flexible elements are each configured to flex in response to the support member being coupled to the lower portion of the bathtub to adapt to a shape of the lower portion of the bathtub.

11. The assembly of claim 10, wherein the plurality of flexible elements extend laterally outward from a side of the support member.

12. The assembly of claim 10, wherein the bathtub is a thermoformed, polymeric bathtub.

13. The assembly of claim 10, wherein the plurality of flexible elements are each spaced laterally apart from each another.

14. The assembly of claim 10, wherein the plurality of flexible elements have a shape that is complementary to a shape of the lower portion of the bathtub.

15. The assembly of claim 10, wherein the support member is adhesively bonded to the lower portion of the bathtub.

16. The assembly of claim 10, wherein the support member comprises a base including an upper surface that is complementary to a lower surface of the bathtub.

17. The assembly of claim 16, wherein the base includes a grid-like structure located opposite the upper surface.

18. The assembly of claim 16, wherein the support member further comprises a drain aperture disposed in the base, the bathtub further comprises a drain opening, and the drain aperture of the base is configured to communicate with the drain opening of the bathtub.

* * * * *